United States Patent [19]

Muller et al.

[11] 4,378,151

[45] Mar. 29, 1983

[54] APPARATUS FOR DEVELOPING PHOTOSENSITIVE MATERIAL WITH A MAGNETIC ROTOR CIRCULATING MEANS

[75] Inventors: Mathias Muller, Oberstenfeld; Gerhard Schmidtchen, Sachsenheim, both of Fed. Rep. of Germany

[73] Assignee: Durr-Dental GmbH & Co., KG., Fed. Rep. of Germany

[21] Appl. No.: 263,132

[22] Filed: May 13, 1981

[30] Foreign Application Priority Data

May 16, 1980 [DE] Fed. Rep. of Germany ..... 3018653

[51] Int. Cl.[3] ..... G03D 3/04

[52] U.S. Cl. ..... 354/322; 354/324; 354/328; 366/274; 417/420

[58] Field of Search ..... 354/316, 320, 321, 322, 354/328, 324; 366/273, 274, 127; 417/420

[56] References Cited

U.S. PATENT DOCUMENTS

| | | | |
|---|---|---|---|
| 3,116,913 | 1/1964 | Lane | 366/274 |
| 3,760,705 | 9/1973 | Miller | 354/322 |
| 4,152,099 | 5/1979 | Bingler | 417/420 |
| 4,255,039 | 3/1981 | Hope et al. | 354/328 |

FOREIGN PATENT DOCUMENTS

| | | |
|---|---|---|
| 839269 | 5/1952 | Fed. Rep. of Germany . |
| 1293585 | 12/1969 | Fed. Rep. of Germany . |
| 1493776 | 11/1977 | United Kingdom . |

*Primary Examiner*—L. T. Hix
*Assistant Examiner*—Alan Mathews
*Attorney, Agent, or Firm*—Robert E. Burns; Emmanuel J. Lobato; Bruce L. Adams

[57] ABSTRACT

Small apparatus for developing photosensitive materials, in particular table-top apparatus, comprises a housing divided by partitions into a plurality of processing stations, for example a developing station, a fixing station and a washing station. Each of the stations comprises a trough containing the respective processing liquid. The photosensitive material to be developed is conveyed by transport rolls from an inlet, through the successive stations and out of an outlet. Liquid in a trough is circulated by a device comprising a magnetic rotor which rotates in a submerged rotor housing in the trough and has inlet openings in its cover and a tangential outlet opening in its periphery. The rotor is rotated by a rotating magnetic field arrangement outside the trough. In one embodiment it comprises a motor-driven permanent magnet. In another, it comprises magnetic coils arranged in a circle and energized sequentially.

20 Claims, 7 Drawing Figures

Fig.3
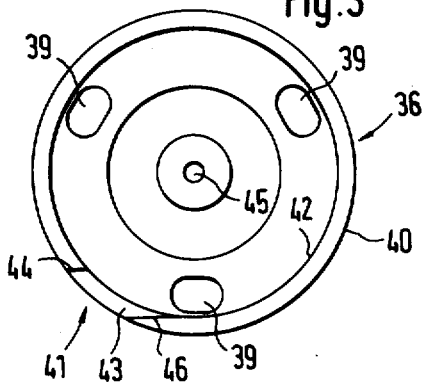
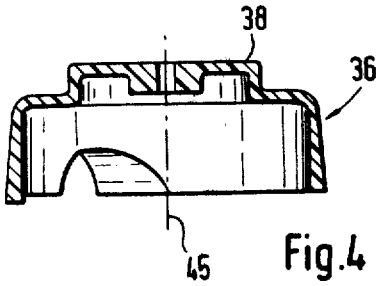
Fig.4
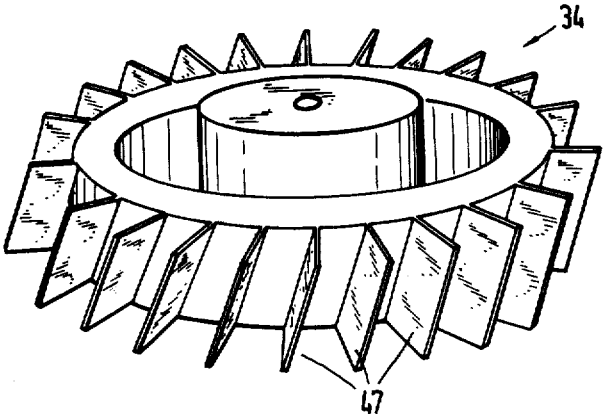
Fig.5
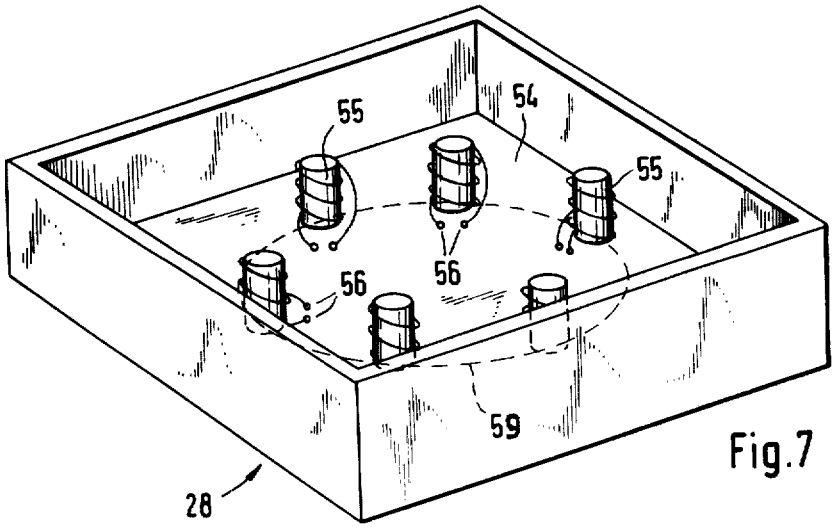
Fig.7

APPARATUS FOR DEVELOPING PHOTOSENSITIVE MATERIAL WITH A MAGNETIC ROTOR CIRCULATING MEANS

FIELD OF INVENTION

The invention relates to developing apparatus for photosensitive material comprising an apparatus housing with a plurality of processing stations each having respectively a trough filled with a chemically active circulating fluid of desired temperature and concentration through which the photosensitive material is transported.

In particular the invention relates to small developing apparatus with a trough capacity of about 1 to 5 liters. Such small apparatus can be used either as table apparatus or as small individual apparatus, if necessary on a stand, for use primarily in medical, dental and graphic fields. In medical and dental fields it is used in developing photosensitive material, primarily X-ray film. In the graphic arts predominantly light sensitive film or light sensitive coated paper are developed. The film development in these areas is carried out only as incidental work by persons who are not specially trained. This small apparatus hence lays particular value on simple construction and easy operation.

BACKGROUND OF THE INVENTION

It is known from experience that untrained personnel make operating errors especially in renewing the processing fluids and in cleaning the troughs. This work is usually carried out weekly or at longer periods in the case of limited use. First the processing fluid is let out, pumped out or poured out then the troughs are flushed with cleaning fluid which is washed out with water and then the troughs are filled with new processing fluids. A particular complication of this cleaning work is that not only the troughs but also the associated fluid circulating system must be cleaned. The fluids must be continually pumped in order to maintain the temperature and concentration constant. This is necessary in order to achieve satisfactory quality of the developed pictures. The circulation is generally effected by a pump which is frequently accommodated in the service part of the apparatus and is connected with the trough through supply and return conduits. After draining the fluid from a trough, the trough and pump system is flushed with a cleaning fluid. Then the cleaning fluid is to be very carefully removed as otherwise this will chemically disturb the freshly filled fluid. The pump system is hence to be repeatedly flushed with fresh water. Here air is frequently arised through carelessness so that the cleaning fluid is not completely removed whereby the newly filled fluid is wholly or at least to a certain percentage chemically spoiled so that it must soon be again renewed in order to obtain a satisfactory picture quality.

SUMMARY OF THE INVENTION

The invention is directed at a problem of devising developing apparatus of this kind with circulating means which can be simply and quickly cleaned even by unskilled persons without special precautions and which assures sufficient circulation to attain a constant temperature and concentration of the circulated fluid.

In accordance with the invention it is provided that in developing apparatus of this kind a fluid circulating magnetic rotor is rotatably mounted close to a wall lying below the upper surface of the liquid with its axis of rotation perpendicular to the wall and having a magnetic field component lying perpendicular to the axis of rotation and that outside the trough there is a rotating magnetic field arrangement with a magnetic field acting on the magnetic rotor.

This arrangement of a circulating system has the advantage that supply and return conduits of a pump are eliminated and moreover that the circulating device itself is directly in the fluid trough. Hence, in cleaning the trough and washing out the trough with clean water, the circulating device also is cleaned and rinsed. The repeated rinsing of the pump circuit is thereby eliminated. Also eliminated is the possibility of error by unskilled persons which hitherto has led to unclean work. Possible damage of a pump through running dry is also excluded.

The circulation of fluid through magnetically driven bars is well known from chemical laboratories and the magnetic stirrers therein used. These magnetic stirrers usually comprise a hot plate under which a bar magnet is rotatably arranged. In a magnetic stirrer of this kind there is usually a glass vessel which contains the fluid and in which is inserted a bar magnet encased in glass or other material that is not attacked by the fluid. With correct positioning of the inserted bar magnet relative to the bar magnet of the stirrer, the inserted bar magnet is carried along with the driven bar magnet of the stirrer and rotated in the glass vessel. The satisfactory operation of such magnetic stirrer must be constantly watched by the laboratory personnel. It is critical to watch the rotational speed of the stirrer as the inserted bar magnet can be thrown out of the field of force of the driven bar magnet at higher rotatational speeds. This occurs more frequently when the viscosity of the liquid to be stirred is decreased through an increase in temperature or through thinning or through the stirring itself. A direct use of such magnetic stirrer is quite impossible in the present case since here it is assumed that the stirrer is continually observable and that the observation and supervision is carried out by trained laboratory personnel. The invention makes use of the principle of the magnetic stirrer and gives it a construction which is usable for operation also by untrained personnel in an opaque trough in which transport mechanism and photosensitive material is present and which nevertheless is of very simple construction and is always dependable and operates without danger of damaging photosensitive material and assures sufficient circulation of the fluid to achieve constant temperature and concentration.

To simplify the construction of the circulating mechanism it helps when the pivot of the magnetic rotor is fast with the trough wall. The trough wall is understood to be either a side wall or the bottom of the trough. The magnetic rotor and its housing are located in such position below the upper surface of the fluid as to leave sufficient clearance for the transport system for the photosensitive material. The best position depends as a rule on the design of the transport system. An especially simple construction is provided when the pivot is formed on the trough wall of the same material from which the trough wall is formed.

To reduce still further the danger of the magnetic rotor being damaged, it is advantageous not only to guide it but also to protect it by a housing which has at least one inlet opening and at least one outlet opening. Such a housing also cooperates in circulating the fluid in a predetermined direction. For this purpose it is especially advantageous when the inlet opening is in the top surface of the rotor housing, the peripheral surface is circular and the outlet opening is in the peripheral surface with parallel walls of which the one - farthest from the rotor axis is tangent to the circular inner peripheral surface. The housing is then so oriented that this tangential surface lies in the direction in which the discharged fluid is to flow.

As the magnetic rotor a simple bar magnet can, for example, be used. However, as a rotary movement is to be effected it is advantageous to use a circular ring magnet on the periphery of which there can be magnetized a plurality of alternating poles so as to provide an especially strong coupling with a driving magnetic field.

The magnetic rotor can comprise a metallic magnet. However, it is advantageous to use a magnetic ceramic oxide, in particular a hard ferritic material since such material permits essentially higher magnetization. However, as such magnetic ceramic oxide material is frequently frangible, it is advantageous to shrink this in a plastic rotary wheel. Advantageously this plastic rotary wheel is circularly symmetric.

This plastic rotary wheel or the circular ring magnet itself can run directly on a pivot provided on the trough wall. The pivot will thereby certainly be worn out. This is especially a disadvantage when the pivot is formed directly on the trough wall as it cannot then be replaced. It is hence advantageous when the plastic rotary wheel runs on a ceramic oxide bushing which is secured on the pivot and is engaged in the rotary wheel. Upon the plastic rotary wheel or the ceramic oxide bushing being worn out, these can be easily replaced. In order to assure that the ceramic oxide bushing is fixed on the pivot so that it will not turn on the pivot and thereby wear it out, it is advantageous when the ceramic oxide bushing has on the side facing the trough wall a recess in which a projection on the trough wall engages.

With 1 to 3 liters of liquid in the trough it is sufficient, and with up to 1 liter of liquid it is advantageous when the peripheral surface of the plastic rotary wheel is completely smooth. However, with larger amounts of liquid it is advantageous when the outer peripheral surface of the plastic rotary wheel is provided with vanes.

In order to favor simple and good cleaning of the circulating system, it is advantageous to space the under surface of the plastic rotary wheel from the trough wall to allow the free flow of fluid between the trough wall and the under surface. In this manner the cleaning fluid and the rinsing water can easily penetrate this space.

The rotary magnetic field arrangement driving the magnetic rotor likewise comprises as a particularly simple embodiment a rotary driven permanent magnet. When the magnetic rotor comprises a circular ring magnet it is advantageous when the permanent magnet of the rotary magnetic field arrangement is formed as a circular ring magnet whereby an especially good coupling between the two magnets is obtained. The arrangement of such a circular ring magnet on the shaft of an electric motor leads to an especially simple and inexpensive construction.

The rotary magnetic field arrangement has a very limited weight, which is especially important for small apparatus, when it comprises electro magnets arranged in a circle of the diameter of the magnetic rotor and switched one after another. The control circuit for switching on the electromagnets one after another advantageously is an integrated switching circuit which has only a fraction of the weight of an electric motor. Hence, such a rotary magnetic field arrangement is essentially lighter than one which comprises an electric motor.

For all embodiments of the proposed developing apparatus the reduction of the weight of the circulating system and thereby the entire weight of the apparatus is a very important advantage over known apparatus. The proposed construction moreover leads to smaller space requirements in comparison with known circulating systems. This saving of space contributes likewise to a reduction of weight of the apparatus and leads to a compact construction which is demanded for small apparatus in particular table apparatus.

It contributes to the ease of servicing and maintenance of the proposed circulating system when the rotary magnetic field arrangement and the ancillary driving means are arranged as a unit with electrical contacts which can be inserted in the apparatus housing. Of the entire arrangement the electro motor or the integrated switching circuit is practically the only element in which a defect can occur. It is then not necessary to open the whole apparatus housing to remove and replace the pump as in prior circulating devices but is sufficient simply to pull out the insert with the magnetic field arrangement and slip in a new insert. The apparatus is then immediately ready for use. The insert can, outside the apparatus, be repaired in a simple manner without limiting the time of use of the developing apparatus. An especially simple construction is provided when the rotating magnetic field arrangement of several adjacent troughs comprises a common insert. This is especially advantageous when the magnets of the rotating magnetic field arrangement have a common driving means thus, for example, only one common electric motor.

BRIEF DESCRIPTION OF DRAWINGS

The invention will be further explained with reference to the embodiments illustrated by way of example in the accompanying drawings in which:

FIG. 3 is a bottom view of the rotor housing;

FIG. 4 is a cross section through the rotor housing;

FIG. 5 is a perspective view of a plastic circulating wheel with vanes;

FIG. 7 is a perspective view of a further rotary magnetic field arrangement for driving a magnetic rotor according to FIG. 2.

DESCRIPTION OF PREFERRED EMBODIMENTS

Figure 1:
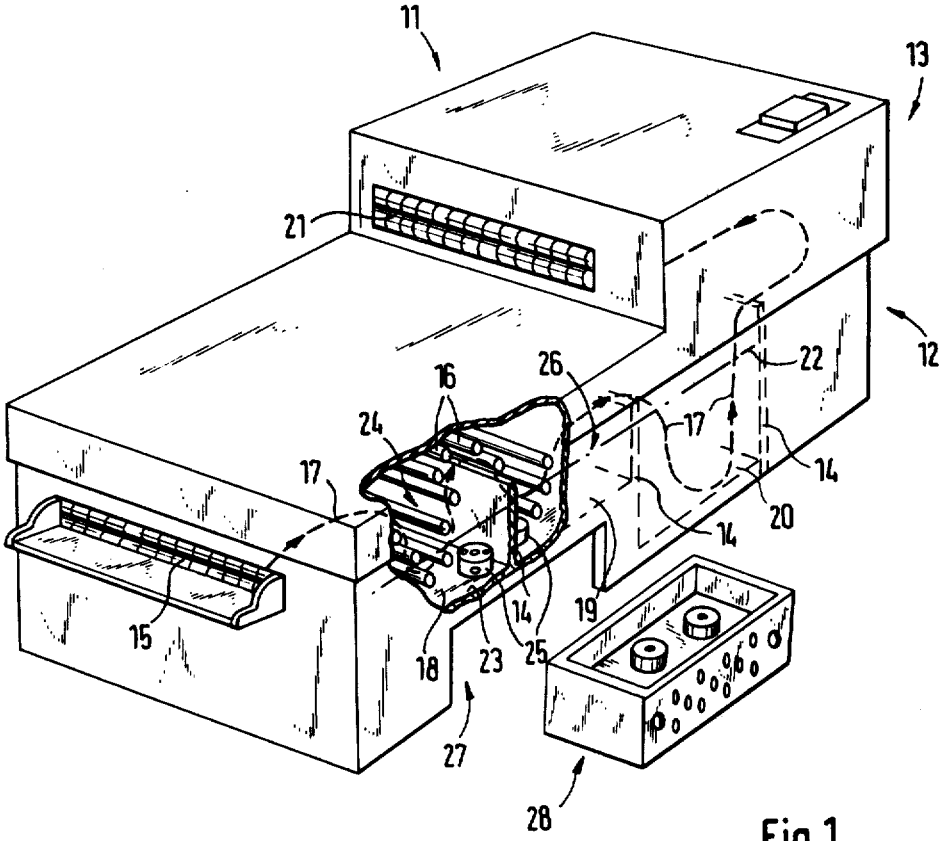
FIG. 1 is a perspective view of a developing apparatus with a circulation device in accordance with the invention.

In FIG. 1, the numeral 11 designates the housing of table developing apparatus for photosensitive material. This comprises a lower portion 12 and an upper portion 13. The lower portion of the housing is divided by several partitions 14 into individual processing stations. At its forward side the lower portion 12 of the housing has a film entrance slot 15 through which the photosensitive material is fed into the developing apparatus. The photosensitive material is then taken over by the transport system 16 which is here shown as rollers. These transport rollers are driven by gears and/or toothed belts with the same peripheral speed. The path of the photosensitive materials is indicated by the broken line 17. The material arrives first in the developing liquid 18 of a developing station, from there is conveyed by the transport roller 16 into the fixing liquid 19 in a fixing station, then arrives over further transport rollers in the water 20 of a washing station and from there is transported into the upper housing portion 13 in which it is dried and then discharged through a film discharge slot 21. However, the invention is not concerned with the overall design of the developing apparatus of which many further forms other than the one herein described exists or are conceivable but rather with the circulating devices for the liquid of the processing stations.

The upper surface of the different liquids of the processing stations is assumed to be the same and is designated by the dot-dash line 22 in FIG. 1. However, it is unimportant for the invention whether the upper surfaces of the different liquids are at the same or different heights. In FIG. 1 a rotor housing 25 of a circulating device in accordance with the invention is shown on the bottom 23 of the developing trough 24 below the upper surface 22 of the developing liquid 18. A corresponding housing 25 is partially shown on the bottom of the fixing trough 26.

On a side face of its lower portion 12 the apparatus housing 11 has an opening 27 in which is insertable a plug-in unit with a rotating magnetic field device 28 which is shown pulled out in FIG. 1. When inserted, the plug-in unit fits exactly under the rotor housings 25.

Figure 2:
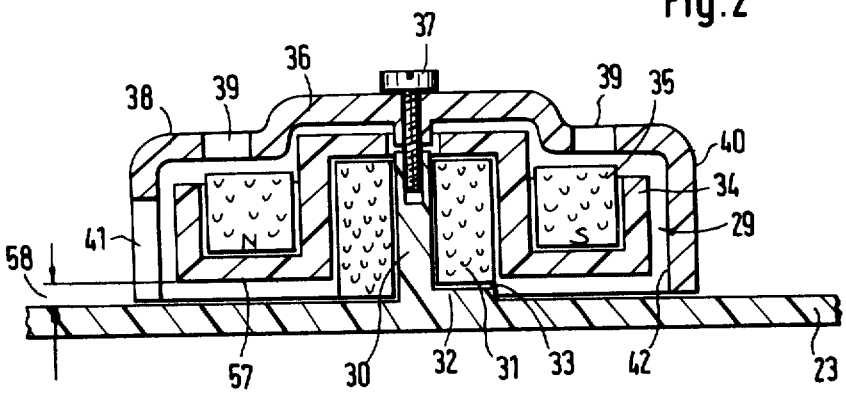
FIG. 2 is a cross section through a magnetic rotor on a pivot in a rotor housing.

An especially advantageous embodiment of the mounting of a magnetic rotor 29 is shown in FIG. 2. A pivot pin 30 is formed on the bottom 23 of a processing station. Over the pivot pin there is slipped a ceramic oxide bushing 31 which advantageously is formed of aluminum oxide ceramic. The bottom 23 and pivot pin 30 are formed with a projection 32 which engages in a recess 33 in the ceramic oxide bushing 31 and prevents this from turning relative to the pivot pin 30. A circular symmetrical plastic rotary wheel 34 runs on this ceramic oxide bushing 31 and is shrunk on a circular ring magnet 35. This magnet is so magnetized that it has a constant magnetic component perpendicular to the pivot pin. In the case illustrated in cross section, a south pole S is at the right of the pivot pin and a north pole N is at the left of the pivot pin. Over this whole arrangement there is a rotor housing 36 which together with the ceramic oxide bushing 31 is held by a screw 37 screwed into the pivot pin 30. The rotor housing 36 has on its cover 38 fluid inlet openings 39 and on its outer peripheral surface 40 a fluid outlet opening 41.

The magnetic rotor 29 must not necessarily be guided by the pivot pin 30. It is rather possible that, for example, no pivot pin is provided but that the housing is otherwise secured on the trough and that the magnetic rotor is guided by the inner peripheral surface 42 of the housing.

The plastic rotor wheel 34 has a lower surface 57 formed as a plane annular surface. It is mounted by the ceramic oxide bushing 31 in such manner that between the trough bottom 23 and the lower surface 57 there is a space 58 which permits free flow of the fluid present between the trough bottom and the lower face. The fluid must then run out of this region when the processing fluid or the cleaning fluid or the rinsing water is drained from a trough. The draining is advantageously effected through an opening in the bottom 23 of the trough. The fluid can, however, be pumped out or poured out. For very small developing apparatus with a trough capacity of about 1 liter pouring out is most convenient, for larger apparatus draining is most expedient. During the entire cleaning and rinsing procedure, the proposed circulating device can be allowed to run. Thereby good rinsing of the circulating device is assured. With prior pumps this was not always permissible as many fluid pumps can only be run when supplied with fluid. The pumps were hence stopped during the cleaning and rinsing procedure. However, the proposed circulating device can run dry for long periods of time since the plastic rotary wheel and the ceramic oxide bushing can run well also without fluid lubrication.

FIG. 3 shows a rotor housing 36 as seen from the bottom and FIG. 4 shows a cross section through such a housing. In the cover 38 of the housing there are three fluid inlet openings 39 spaced approximately 120° from one another. The inner peripheral surface 42 and the outer peripheral surface 40 are circular. The fluid outlet opening 41 is formed as a recess from the bottom of the housing. It has two side walls and an upper wall 43. The side wall 44 which lies near the central axis 45 and the side wall 46 which lies farther from the central axis 45 are parallel to one another. The further spaced wall 46 is formed as a tangential surface to the inner peripheral surface 42. Through this fluid outlet opening the circulating fluid is discharged from the housing tangentially to the periphery of the magnetic rotor. The housing is mounted on the trough wall so that the fluid is circulated in a predetermined direction.

FIG. 5 is a perspective view of a plastic rotary wheel 34 which has vanes 47 for increasing the pump action. Such a plastic rotary wheel can be used when large amounts of fluid for example with a trough capacity of from 3 liters must be circulated.

Figure 6:
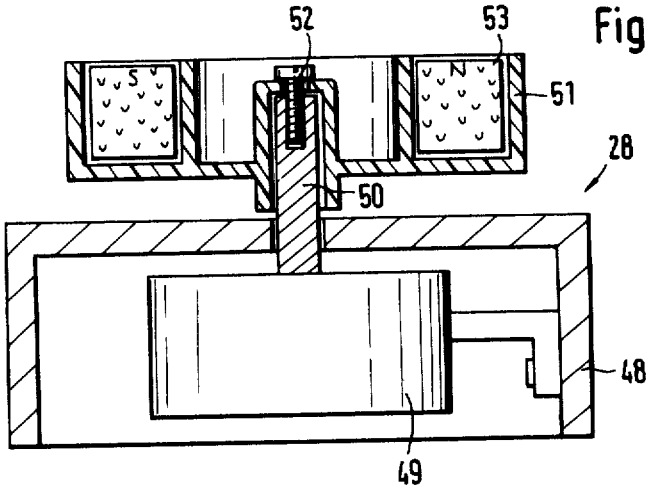
FIG. 6 is a section through a rotary magnetic field arrangement for driving a magnetic rotor according to FIG. 2.

FIG. 6 shows a section through a rotating magnetic field arrangement which is usable for driving a magnetic rotor as shown in FIG. 2. On a mounting part 48 there is mounted an electric motor 49 on the shaft 50 of which a plastic magnet mounting wheel 51 is secured by a screw 52 screwed into the shaft 50. In the plastic magnet mounting wheel is shrunk a circular ring magnet 53. This can consist of a metal magnet but is advantageously formed of oxide material, preferably a ferrite. With a ferrite an especially high magnetic field strength can be obtained. The circular ring magnet is magnetized so that it has a component perpendicular to the rotary axis 50. In the cross section this is indicated through a north pole N lying to the right of the axis and a south pole S lying to the left of the axis. Preferably the magnetic ring magnets 35 and 53 of the magnetic rotor 29 and rotating magnetic field arrangement 48 respectively are magnetized the same so that there is an especially large interaction between them.

The rotating magnetic field arrangement is positioned under the magnetic rotor inside the trough so that the rotary axis 50 of the electric motor 49 coincides with the rotary axis of the magnetic rotor. In the embodiment according to FIG. 1 magnetic rotors are provided in adjacent troughs, namely in the developing trough 24 and in the fixing trough 26. These are driven respectively through ring magnets on a common plug-in unit. The drive of the circular ring magnets can be effected either through separate electric motors or through an electric motor common to both.

FIG. 7 shows a further embodiment of a rotating magnetic field arrangement 28 which can be used directly as a plug-in unit according to FIG. 1 in the recess 27 of an apparatus housing 11. On a common mounting plate 54 there are mounted six electro magnets 55 which are arranged in a circle 59 of approximately the diameter of the magnetic rotor. Each electro magnet 55 has two terminals 56 through which it is supplied with electrical energy. The magnets are energized in series so that a rotating magnetic field is produced. This series switching is effected through the use of a commercially available switching circuit. An embodiment of this kind can be made especially light and compact.

The described embodiments show that the proposed circulating device makes possible an especially light and compact construction of a developing apparatus. It ensures, moreover, a very simple servicing of such apparatus with respect to its cleaning and maintenance. The proposed developing apparatus is therefore especially advantageous for small apparatus which typically is made with a trough capacity of about 1 to 5 liters and frequently as table apparatus, as such apparatus is almost always operated by personnel who are not specially trained.

We claim:

1. Apparatus for developing photosensitive material, comprising an apparatus housing with a plurality of processing stations each comprising walls defining a trough adapted to be filled with liquid to a predetermined level, transport means for transporting said photosensitive material successively through the liquids in said troughs, and means for circulating liquid in a trough, said circulating means comprising a circular rotor housing mounted on a wall of said trough below the upper surface of liquid in said trough, said rotor housing having a peripheral wall and a cover with at least one inlet opening in said cover and an outlet opening in said peripheral wall, a rotor rotatable in said rotor housing about an axis perpendicular to said wall, said rotor comprising magnetic material, and driving means outside said wall for producing a magnetic field rotating about said axis and penetrating said wall to act on said magnetic material to drive said rotor in rotation about said axis and thereby draw liquid from said trough in said inlet opening and discharge liquid into said trough from said outlet opening.

2. Developing apparatus according to claim 1, in which said rotor is rotatable on a pivot shaft fixed on said trough wall and projecting into said rotor housing.

3. Developing apparatus according to claim 1, in which said outlet opening is approximately tangential to said peripheral wall of said rotor housing.

4. Developing apparatus according to claim 1, in which said magnetic material of said rotor comprises a ring magnet concentric with said rotor and permanently magnetized with opposite poles disposed diametrically opposite one another.

5. Developing apparatus according to claim 4, in which said ring magnet is composed of ceramic oxide and is encased in a symmetrical plastic rotary wheel.

6. Developing apparatus according to claim 5, in which said plastic rotary wheel is rotatably supported by a ceramic oxide bushing on a pivot shaft projecting perpendicularly from said wall into said rotor housing.

7. Developing apparatus according to claim 6, in which said ceramic oxide bushing has in an end facing said wall a recess receiving a projection on said wall to restrain said bushing from rotation.

8. Developing apparatus according to claim 1, in which said rotor has vanes on its outer peripheral surface.

9. Developing apparatus according to claim 1, in which said rotor is spaced from said wall to provide a drain space therebetween.

10. Developing apparatus according to claim 1, in which said driving means comprises a permanent magnet rotatable about said axis and means for driving said magnet in rotation.

11. Developing apparatus according to claim 10, in which said permanent magnet of said driving means is a ring magnet having opposite poles disposed diametrically opposite one another.

12. Developing apparatus according to claim 1, in which said driving means comprises a plug-in unit and in which said apparatus housing has a receptacle for receiving said driving means coaxial with said rotor of said circulating means.

13. Developing apparatus according to claim 12, in which said apparatus housing comprises two of said troughs adjacent one another with said circulating means in each of said troughs, and in which said driving means comprises a plug-in unit for driving the rotors of said circulating means in both of said adjacent troughs.

14. Developing apparatus according to claim 13, in which said plug-in unit comprises a single motor for said driving means for driving the rotors of said circulating means in both of said adjacent troughs.

15. Developing apparatus according to claim 1, in which said driving means comprises a plurality of electromagnets arranged in a circle concentric with said axis and having a diameter approximately equal to that of said rotor and means for energizing said electromagnets sequentially to produce a rotating magnetic field.

16. Apparatus for developing photosensitive material, comprising an apparatus housing with a plurality of processing stations each comprising walls defining a trough adapted to be filled with liquid to a predetermined level, transport means for transporting said photosensitive material successively through the liquids in said circulating means comprising a rotor rotatable in said trough below the liquid level about an axis perpendicular to said wall of said trough, said rotor comprising magnetic material, driving means outside said wall for producing a magnetic field rotating about said axis and penetrating said wall to act on said magnetic material to drive said rotor in rotating about said axis, said driving means comprising a removable plug-in unit and said housing having a receptacle for receiving said plug-in unit in position to drive said rotor.

17. Developing apparatus according to claim 16, in which said housing comprises two of said troughs adjacent to one another with said circulating means in each of said troughs, and in which said driving means comprises a single plug-in unit for driving the rotors of said circulating means in both of said adjacent troughs.

18. Apparatus for developing photosensitive material, comprising an apparatus housing with a plurality of processing stations each comprising walls defining a trough adapted to be filled with liquid to a predetermined level, transport means for transporting said photosensitive material successively through the liquids in said troughs, and means for circulating liquid in a trough, said circulating means comprising a rotor rotatable in said trough below the liquid level about an axis perpendicular to said wall of said trough, said rotor comprising magnetic material, driving means outside said wall for producing a magnetic field rotating about said axis and penetrating said wall to act on said magnetic material to drive said rotor in rotating about said axis, said driving means comprising a plurality of electromagnets arranged in a circle concentric with said axis and having a diameter approximately equal to that of said rotor and means for energizing said electromagnets sequentially to produce a rotating magnetic field.

19. Developing apparatus according to claims 18, in which said driving means comprises a casing having a mounting plate parallel to said wall of said trough, said electromagnets comprising spindles mounted on said plate in circle and windings on said spindles.

20. Developing apparatus according to claim 19, in which said housing has a recess to receive said casing as a plug-in unit in position for said driving means to drive said rotor.

* * * * *